US007005785B2

(12) United States Patent
Kim

(10) Patent No.: US 7,005,785 B2
(45) Date of Patent: Feb. 28, 2006

(54) CATHODE RAY TUBE WITH STRENGTHENED SHADOW MASK

(75) Inventor: Sung-Hun Kim, Kyeongsangbuk-Do (KR)

(73) Assignee: LG Philips Displays Korea Co., Ltd., Kumi (KR)

( * ) Notice: Subject to any disclaimer, the term of this patent is extended or adjusted under 35 U.S.C. 154(b) by 0 days.

(21) Appl. No.: 10/698,380

(22) Filed: Nov. 3, 2003

(65) Prior Publication Data

US 2004/0239230 A1 Dec. 2, 2004

(30) Foreign Application Priority Data

Feb. 10, 2003 (KR) ..... 10-2003-0008302

(51) Int. Cl.
*H01J 29/80* (2006.01)

(52) U.S. Cl. ..... 313/402

(58) Field of Classification Search ..... 313/402–407; 315/370
See application file for complete search history.

(56) References Cited

U.S. PATENT DOCUMENTS

| | | | | |
|---|---|---|---|---|
| 3,766,419 | A * | 10/1973 | Barbin | 313/403 |
| 5,616,985 | A * | 4/1997 | Hosotani | 313/403 |
| 5,990,607 | A | 11/1999 | Tseng et al. | 313/407 |
| 6,465,945 | B1 * | 10/2002 | Tsuchida et al. | 313/461 |
| 6,486,596 | B1 * | 11/2002 | Inoue et al. | 313/402 |
| 6,548,954 | B1 * | 4/2003 | Ishii et al. | 313/402 |

FOREIGN PATENT DOCUMENTS

| | | |
|---|---|---|
| CN | 1095523 A | 11/1994 |
| CN | 1110829 A | 10/1995 |

* cited by examiner

*Primary Examiner*—Joseph Williams
*Assistant Examiner*—Peter Macchiarolo
(74) *Attorney, Agent, or Firm*—Birch, Stewart, Kolasch & Birch, LLP

(57) ABSTRACT

A cathode ray tube comprising a panel having an outer surface which is substantially flat and an inner surface which has a radius of curvature, and a shadow mask having a plurality of apertures through which electron beams pass, wherein a ratio Sh/Sv of a horizontal dimension Sh of the aperture to a vertical dimension Sv of the aperture satisfies a condition of Sh/Sv<1 at a central portion of the shadow mask, and thereby improving strength of the shadow mask. Thusly, deformation of the shadow mask caused by an external impact or the like can be minimized, and a grade of color purity of a screen can be maintained optimally.

31 Claims, 5 Drawing Sheets

CATHODE RAY TUBE WITH STRENGTHENED SHADOW MASK

This Nonprovisional application claims priority under 35 U.S.C. § 119(a) on patent application No(s). 10-2003-0008302 filed in KOREA on Feb. 10, 2003, the entire contents of which are hereby incorporated by reference.

BACKGROUND OF THE INVENTION

1. Field of the Invention

The present invention relates to a cathode ray tube, and particularly to a cathode ray tube capable of optimizing a grade of color purity of a screen by improving strength of a shadow mask and thus preventing deformation caused by an external impact or the like.

2. Description of the Conventional Art

A cathode ray tube is a device for converting an electric signal into an electron beam and emitting the electron beam to a phosphor screen to realize an image. The cathode ray tube is widely used in the conventional art since excellent display quality is achieved at an affordable price.

A cathode ray tube will be explained with reference to attached drawings. FIG. 1 is a schematic view showing an example of a cathode ray tube of the conventional art. As shown in FIG. 1, the cathode ray tube includes a panel 3 of a front glass; a funnel 2 of a rear glass engaged to the panel 3 for forming a vacuum space; a phosphor screen 13 deposited on an inner surface of the panel 3 and serving as a phosphor; an electron gun 6 for emitting an electron beam 5 which makes the phosphor screen 13 emit light; a deflection yoke 7 mounted at an outer circumference surface of the funnel 2 with a predetermined interval for deflecting the electron beam 5 to the phosphor screen 13; a shadow mask 8 installed at a constant interval from the phosphor screen 13; and a mask frame 9 for fixing and supporting the shadow mask 8. The cathode ray tube also includes an inner shield 10 extending from the panel 3 to the funnel 2 for shielding external terrestrial magnetism and thus preventing deterioration of color purity by the magnetism; and a reinforcing band 12 arranged at an outer circumference of the panel 3 for distributing stress generated from the panel 3 and the funnel 2.

As shown in FIG. 2, the shadow mask 8 includes a perforated portion 8*b* having a certain curvature corresponding to curvature of the inner surface of the panel 3 and having a plurality of electron beam passing apertures 8*a* through which the electron beam 5 passes; and a skirt portion 8*c* extended from an outer circumference of the perforated portion 8*b* in a tube axis direction for being fixed at the mask frame 9.

As shown in FIG. 3, the apertures 8*a* of the shadow mask 8 is circular in shape so that a horizontal dimension (Sh) and a vertical dimension (Sv) are identical.

Also, as shown in FIG. 4, in the electron beam passing apertures 8*a*, a width of an electron beam outgoing portion 81*a* (panel side) of the electron beam passing aperture 8*a* is tapered so as to be larger than that of an electron beam incoming portion 82*a* (electron gun side) in order to prevent a diffusion of an electron beam 5 passing therethrough. In order to correspond to an incidence angle of the electron beam, the tapered size becomes gradually large from the central portion toward the peripheral portion of the shadow mask 8.

In the conventional cathode ray tube, the electron beam 5 emitted from the electron gun 6 is deflected by the deflection yoke 7, passes through the plurality of apertures 8*a* of the shadow mask 8, and lands on the phosphor screen 13 formed at the inner surface of the panel 3. Accordingly, the deflected electron beam 5 makes the phosphor formed at the phosphor screen 13 emit light, thereby achieving an image.

Performance of a cathode ray tube can be determined by various factors. In this regard, color purity of an implemented image is one of the most important factors of the cathode ray tube, and the color purity is greatly affected by deformation of the shadow mask 8 caused by an external impact, in most cases.

Specially, since the tapered size of the aperture 8*a* of the shadow mask 8 becomes large from the central portion toward the peripheral portion of the shadow mask 8, a volume and a weight of the shadow mask 8 gradually decrease from the central portion of the shadow mask 8 toward the peripheral portion thereof, and thus the strength of the peripheral portion of the shadow mask 8 is lower than that of the central portion of the shadow mask 8.

Accordingly, in case that an external impact such as dropping occurs on the cathode ray tube, and especially in case that the panel 3 drops toward the ground, the shadow mask 8 is vibrated in the tube axis direction based on the surface thereof, and relatively great vibration is caused at the central portion of the shadow mask 8 than at the peripheral portion due to the relatively great mass of its central portion. Thusly, deformation occurs at the peripheral portion of the shadow mask 8, which has relatively low strength.

Also, in case that the whole size of a cathode ray tube is relatively large, a shadow mask 8 disposed therein becomes more sensitive to an external impact, Thusly, a shadow mask 8 for a large scale cathode ray tube can be permanently deformed by sudden deformation even under a small impact, so its performance is deteriorated.

SUMMARY OF THE INVENTION

Therefore, an object of the present invention is to provide a cathode ray tube including a shadow mask capable of preventing its deformation caused by an external impact by improving strength of the shadow mask.

To achieve this and other advantages and in accordance with the purpose of the present invention, as embodied and broadly described herein, there is provided a cathode ray tube comprising a panel having an outer surface which is substantially flat and an inner surface which has a radius of curvature, and a shadow mask having a plurality of apertures through which electron beams pass, wherein a ratio Sh/Sv of a horizontal dimension Sh of the aperture to a vertical dimension Sv of the aperture satisfies a condition of $Sh/Sv<1$ at a central portion of the shadow mask.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A cathode ray tube is classified into a CPT (color picture tube) for a color television and a CDT (color display tube) for a monitor in accordance with a shape of an aperture formed in a shadow mask for passing an electron beam. That is, a stripe-shaped aperture is formed in a shadow mask of the CPT, and a dot-shaped aperture is formed at a shadow mask of the CDT. The present invention relates to the CDT.

Figure 1:
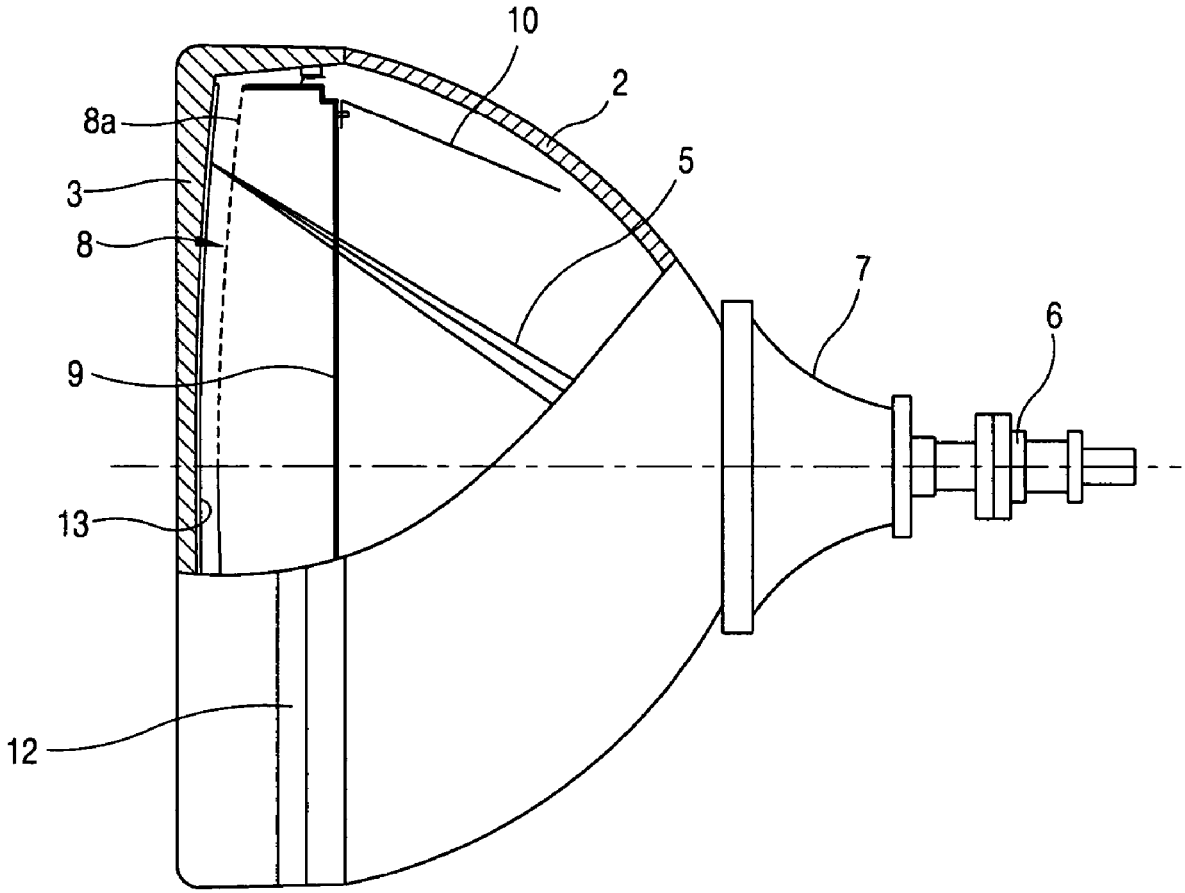
FIG. 1 CONVENTIONAL ART
FIG. 1 is a schematic view showing an example of a cathode ray tube according to the conventional art.
Figure 2:
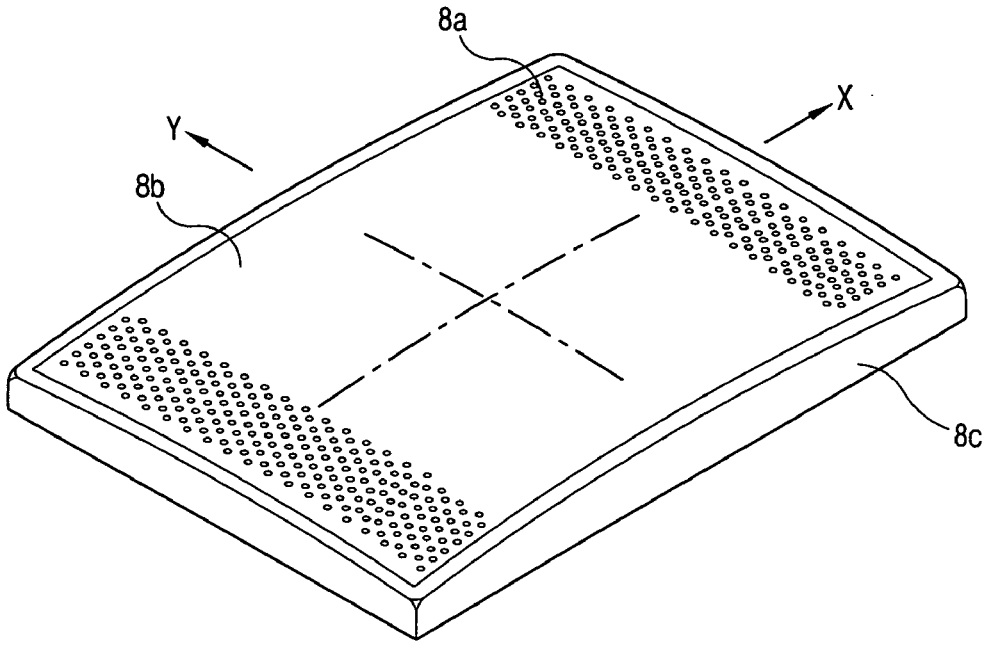
FIG. 2 CONVENTIONAL ART
FIG. 2 is a perspective view showing a shadow mask of a cathode ray tube according to the conventional art.
Figure 3:
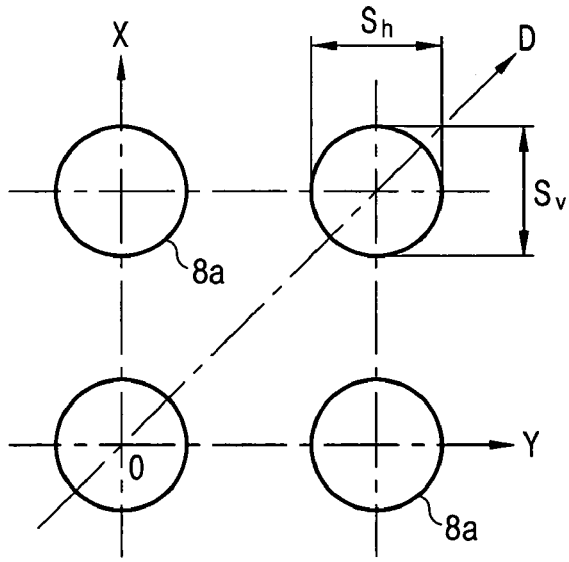
FIG. 3 CONVENTIONAL ART
FIG. 3 is a diagrammatic view showing electron beam passing apertures of a shadow mask provided in a cathode ray tube according to the conventional art.
Figure 4:
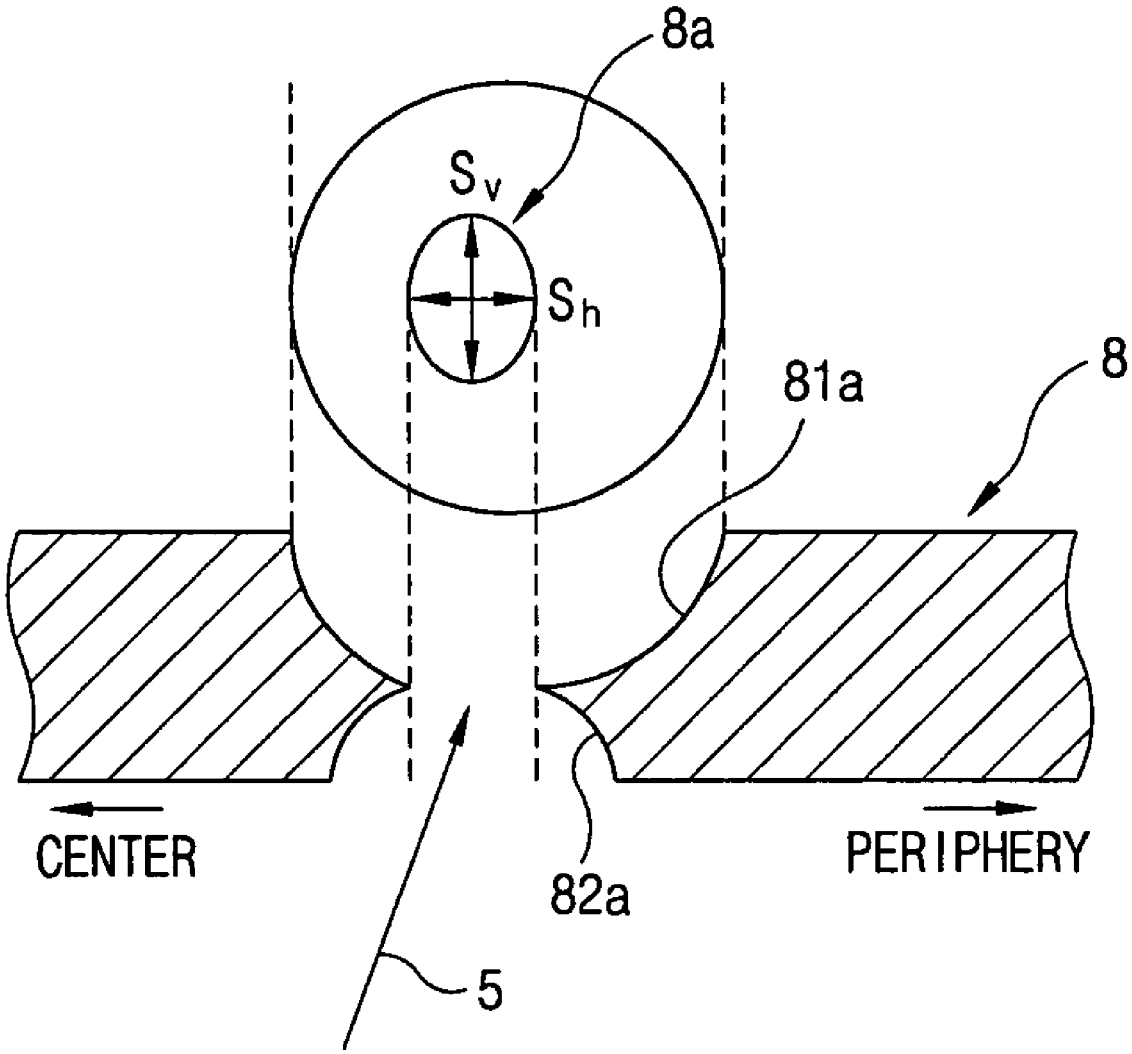
FIG. 4 CONVENTIONAL ART
FIG. 4 is a partial cross-sectional view of an electron beam passing aperture of a shadow mask provided in a cathode ray tube according to the conventional art.
Figure 5:
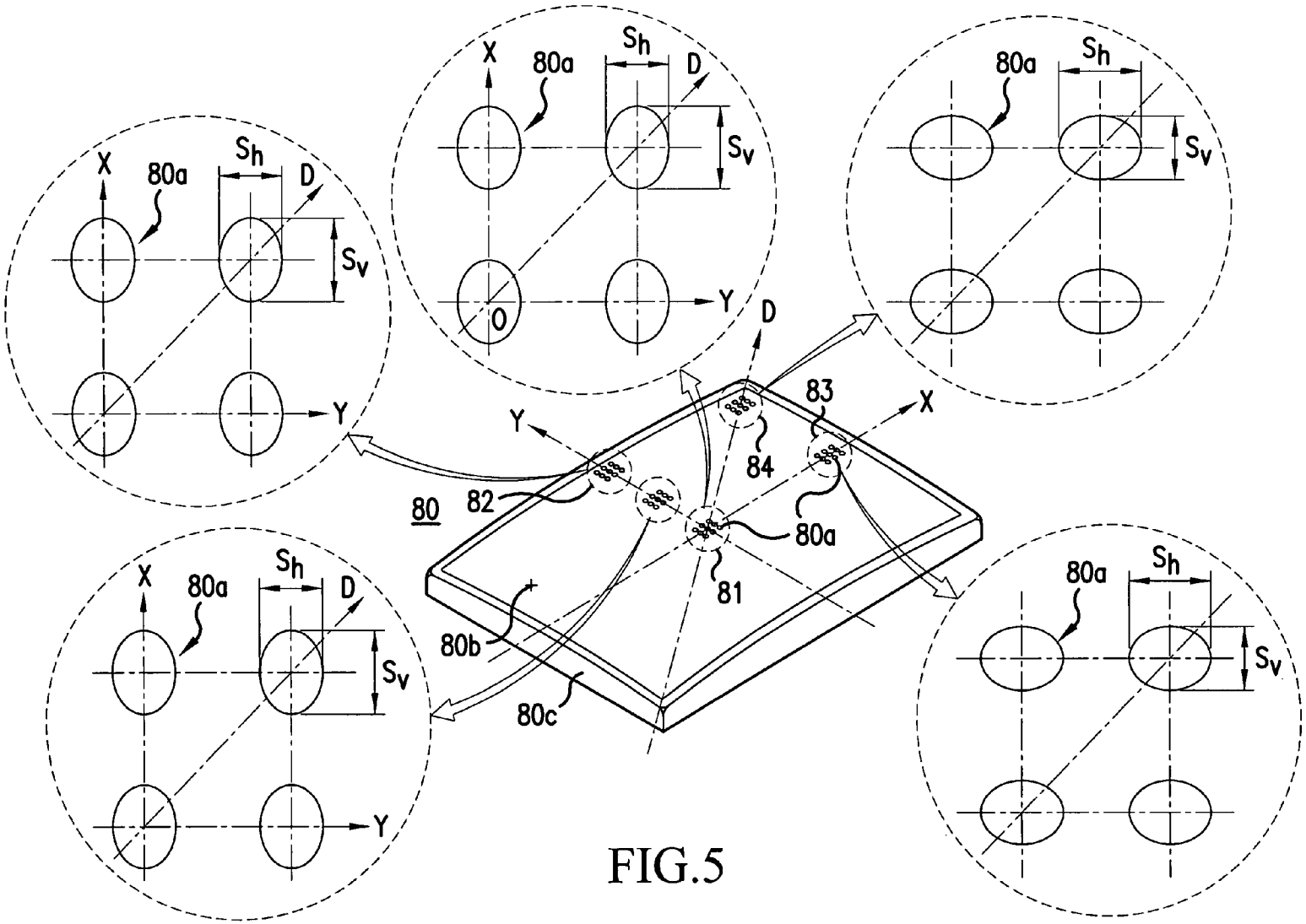
FIG. 5 is a perspective view showing a shadow mask and apertures of a shadow mask provided in a cathode ray tube according to the present invention.

As shown in FIG. 5, a shadow mask 80 according to the present invention, comprises a perforated portion 80*b* having a plurality of apertures 80*a* through which an electron beam passes; and a skirt portion 80*c* coupled with a mask frame for being supported inside the panel.

Generally, the apertures 80*a* are regularly formed over the whole shadow mask 80, and a width of an electron beam outgoing side of the aperture 80*a* is larger than that of an electron beam incoming side of the aperture 80*a* in order to prevent a diffusion of an electron beam passing through the aperture 80*a*. Also, the width of the electron beam outgoing side compared with the width of the electron beam incoming side gradually increases from the central portion 81 of the shadow mask 80 toward the peripheral portion of the shadow mask 80.

In the shadow mask, since its volume and a weight gradually decrease from the central portion of the shadow mask 80 toward the peripheral portion thereof, the strength of the peripheral portion of the shadow mask 80 is lower than that of the central portion 81 of the shadow mask 80. Therefore, in case that an external impact such as dropping occurs on the cathode ray tube, relatively great vibration is generated at the central portion 81 of the shadow mask 80 compare to the peripheral portion of the shadow mask 80. At this time, more severe deformation is caused at the peripheral portion of the shadow mask 80 due to the relatively lower strength compared to the central portion 81 of the shadow mask 80.

Therefore, it is required to reinforce the strength of the peripheral portion of the shadow mask 80 in order to prevent the deformation caused by an external impact.

According to the present invention, an optimum shape of the aperture 80*a* capable of increasing strength of the shadow mask 80 is set by each portion of a long axis (X-axis), a short axis (Y-axis) and a diagonal axis (D-axis) respectively. By this shape optimization of the aperture 80*a*, the shadow mask 80 having strength enough to bear an external impact can be secured. The shadow mask 80 according to the present invention is more effective in case that it is used for a flat type of cathode ray tube in which the panel has a substantially flat outer surface, that is, in case that curvature radius of the shadow mask 80 is greater than 1300 mm.

According to the present invention, an aspect ratio Sh/Sv of a horizontal dimension Sh to a vertical dimension Sv of the aperture 80*a* is smaller than 1 at the central portion 81 of the shadow mask 80, when the dimension of the aperture 80*a* in the long axis (X-axis) direction of the shadow mask 80 is defined as the horizontal dimension Sh, and its dimension in the short axis (Y-axis) direction of the shadow mask 80 is defined as the vertical dimension Sv. Here, preferably, the aspect ratio Sh/Sv satisfies a condition of $0.89 \leqq Sh/Sv \leqq 0.95$ at the central portion 81 of the shadow mask 80. That is, the aperture 80*a* at the central portion 81 of the shadow mask 80 is formed as a vertically elongated shape.

Also, at both end portions 82 of the short axis (Y-axis) of the shadow mask 80, the aperture 80*a* is formed as a vertically elongated shape wherein the aspect ratio Sh/Sv of the aperture 80*a* is smaller than 1. And, at both end portions 83 of the long axis (X-axis) of the shadow mask 80, the aperture 80*a* is formed as a horizontally elongated shape wherein the aspect ratio Sh/Sv is 1 or larger than 1. Also, at both end portions 84 of the diagonal axis (D-axis) of the shadow mask 80, the aspect ratio Sh/Sv of the aperture 80*a* is 1 or larger than 1.

Meanwhile, regions of the perforated portion 80*b* of the shadow mask 80 corresponding to 80%~95% of each distance from a center of the shadow mask 80 to respective ends in the long axis (X-axis) direction, the short axis (Y-axis) direction and the diagonal axis (D-axis) direction are greatly affected by an external impact. Therefore, the shape of the aperture 80*a* is more importantly taken into account in these regions.

The optimum aspect ratio Sh/Sv of the apertures 80*a* of the above-mentioned regions is set, as stated below.

The aspect ratio Sh/Sv of the aperture 80*a* satisfies a condition of $0.90 \leqq Sh/Sv \leqq 0.96$ at the region corresponding to 80%~95% of the distance from the center of the shadow mask 80 to the end of the short axis (Y-axis) of the shadow mask 80. Moreover, it is preferred that the aspect ratio Sh/Sv of the aperture 80 is smaller than 1 on the short axis of the shadow mask 80.

Further, the aspect ratio Sh/Sv of the aperture 80*a* satisfies a condition of $0.95 \leqq Sh/Sv \leqq 1.03$ at the region corresponding to 80%~95% of the distance from the center of the shadow mask 80 to the end of the long axis (X-axis) of the shadow mask 80.

Also, the aspect ratio Sh/Sv of the aperture 80*a* satisfies a condition of $0.95 \leqq Sh/Sv \leqq 1.05$ at the region corresponding to 80%~95% of the distance from the center of the shadow mask 80 to the end of the diagonal axis (D-axis) of the shadow mask 80.

Also, the aspect ratios Sh/Sv of the apertures 80*a* can simultaneously satisfy the conditions of $0.90 \leqq Sh/Sv \leqq 0.96$ at the region corresponding to 80%~95% of the distance from the center to the end of the short axis, $0.95 \leqq Sh/Sv \leqq 1.03$ at the region corresponding to 80%~95% of the distance from the center to the end of the long axis, and $0.95 \leqq Sh/Sv \leqq 1.05$ at the region corresponding to 80%~95% of the distance from the center to the end of the diagonal axis.

As stated above, in the case that the aspect ratios Sh/Sv of the apertures 80*a* of the shadow mask 80 satisfy the ranges simultaneously, the apertures 80*a* are formed so that a ratio of the aspect ratio Sh/Sv at the end portion 84 of the diagonal axis to the aspect ratio Sh/Sv at the central portion 81 of the shadow mask 80 is 1.1 or larger than 1.1. That is, when the ratio Sh/Sv at the central portion 81 of the shadow mask 80 is defined as A, and the ratio Sh/Sv at the end portion 84 of the diagonal axis of the shadow mask 80 is defined as B, a ratio B/A satisfies a condition of B/A≧1.1.

As described above, the aspect ratio Sh/Sv of the aperture 80*a* is limited to minimum 0.89 and maximum 1.05 based on a value figured out from an etching process for forming the aperture 80*a* in the shadow mask 80, and an effect and an experiment for increasing the strength at the peripheral portion of the shadow mask. That is, in case that the aspect ratio Sh/Sv of the aperture 80*a* is smaller than 0.89, there can be a limitation in a producing process for etching the shadow mask 80*a*. In case that the aspect ratio Sh/Sv of the aperture 80*a* is more than 1.05, the effect on the increase of strength of the shadow mask 80 is insufficient.

Meanwhile, the aspect ratio Sh/Sv of the aperture 80*a* is smaller than 1 at the central portion 81 of the shadow mask 80, and the aspect ratios Sh/Sv of the apertures 80*a* are more than 1 at the end portions 83, 84 of the long axis and the diagonal axis. Here, it is preferred that the aspect ratio Sh/Sv of the aperture 80*a* is gradually varied from the central portion 81 of the shadow mask 80 toward the end portions 83, 84 of the long and diagonal axes of the shadow mask 80.

TABLE 1

| | | Sh/Sv | Drop Characteristic (G) |
|---|---|---|---|
| Conventional Art | central portion | 1.00 | 24.2 |
| | end portion of long axis | 1.00 | |
| | end portion of short axis | 1.00 | |
| | end portion of diagonal axis | 1.00 | |
| Embodiment 1 | central portion | 0.92 | 25.0 |
| | end portion of long axis | 0.98 | |
| | end portion of short axis | 0.93 | |
| | end portion of diagonal axis | 0.98 | |
| Embodiment 2 | central portion | 0.89 | 28.0 |
| | end portion of long axis | 0.95 | |
| | end portion of short axis | 0.90 | |
| | end portion of diagonal axis | 0.95 | |

Table 1 shows a comparison of drop characteristics between the conventional cathode ray tube having the shadow mask 80 in which an aspect ratio Sh/Sv of the aperture 80*a* is 1, and the cathode ray tube according to the first and second embodiments of the present invention in which the respective aspect ratio Sh/Sv of the aperture 80*a* is in the above determined ranges corresponding to each portion of the shadow mask 80 as described above.

Here, the drop characteristic is an index indicating the support strength value of the shadow mask. It is measured by dropping the cathode ray tube in which the shadow mask installed. Namely, the drop strength value (G) means a limit value (Gravity, $g=9.83\ m/s^2$) that the shadow mask does not be deformed by drop impact. In case over the limit value shown in Table 1, the shadow mask may be deformed. In more detail, the higher the value, the higher the support strength of the shadow mask, the more easily the shadow mask stands impact.

Figure 6:
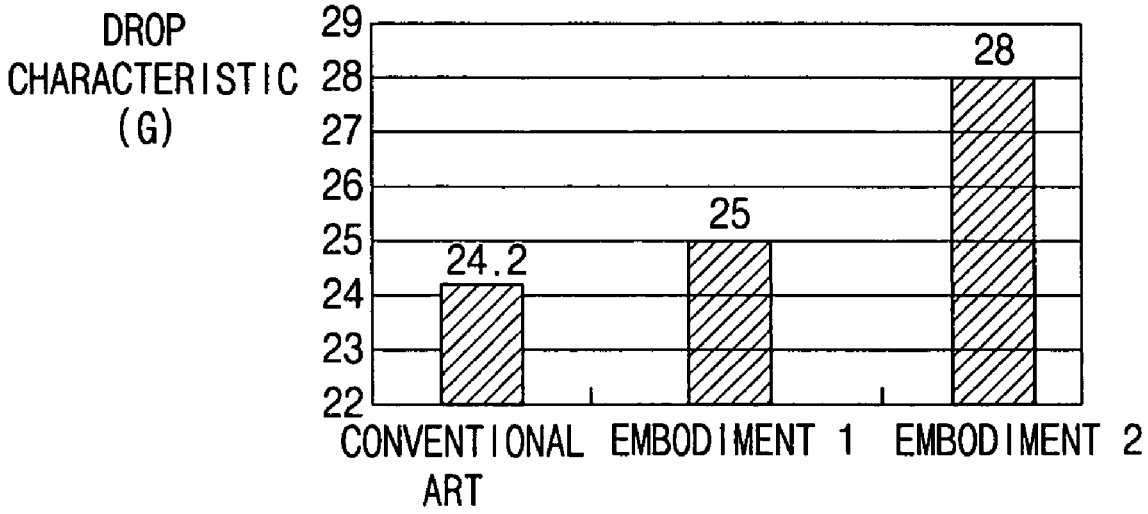
FIG. 6 is a graph comparing drop characteristics of the shadow mask according to the conventional art and the present invention.

As can be known from Table 1 and FIG. 6, in case that the aspect ratios Sh/Sv of the horizontal dimension Sh to the vertical dimension Sv of the apertures 80*a* satisfy the conditions of Sh/Sv≦1 at the central portion 81 of the shadow mask 80, 0.90≦Sh/Sv≦0.96 at the region corresponding to 80%~95% of the distance from the center to the end of the short axis, 0.95≦Sh/Sv≦1.03 at the region corresponding to 80%~95% of the distance from the center to the end of the long axis, and 0.95≦Sh/Sv≦1.05 at the region corresponding to 80%~95% of the distance from the center to the end of the diagonal axis, the support strength value of the drop characteristic increases up to 28G, which is 17% of improvement of the support strength compared to the shadow mask of the conventional art. Also, it is known that the support strength value cannot over 25G in case of a shadow mask having a conventional structure. However, the cathode ray tube according to the present invention can secure the shadow mask having the support strength value over 25G by optimizing the shape of the apertures formed at each portion of the shadow mask.

In a cathode ray tube according to the present invention, a shape of an aperture of a shadow mask is optimized and thereby increasing strength of the shadow mask. Accordingly, the cathode ray tube can prevent deformation caused by an external impact or the like, and optimally maintain a grade of color purity of a screen.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A cathode ray tube comprising:

a panel having an outer surface which is substantially flat and an inner surface which has a radius of curvature; and a shadow mask having a plurality of apertures through which electron beams pass, each of the plurality of apertures at a central portion of the shadow mask having a continuously arcuate periphery, a ratio Sh/Sv of a horizontal dimension Sh of the aperture to a vertical dimension Sv of the aperture satisfying a condition of Sh/Sv<1 at the central portion of the shadow mask;

wherein, by defining the ratio Sh/Sv at the central portion of the shadow mask as A and the ratio Sh/Sv at an end portion of a diagonal axis of the shadow mask as B, a ratio B/A satisfies a condition of B/A≧1.1.

2. The cathode ray tube of claim 1, wherein the ratio Sh/Sv satisfies a condition of Sh/Sv<1 at an end portion of a short axis of the shadow mask.

3. The cathode ray tube of claim 2, wherein the ratio Sh/Sv satisfies a condition of Sh/Sv≧1 at an end portion of a diagonal axis of the shadow mask.

4. The cathode ray tube of claim 2, wherein the ratio Sh/Sv satisfies Sh/Sv≧1 at an end portion in a long axis of the shadow mask.

5. The cathode ray tube of claim 1, wherein the ratio Sh/Sv is satisfies a condition of 0.89≦Sh/Sv≦0.95 at the central portion of the shadow mask.

6. The cathode ray tube of claim 1, wherein the ratio Sh/Sv satisfies a condition of Sh/Sv<1 on a short axis of the shadow mask.

7. The cathode ray tube of claim 1, which is used for a monitor.

8. The cathode ray tube of claim 1, wherein the ratio Sh/Sv satisfies a condition 0.90≦Sh/Sv≦0.96 at a region corresponding to 80%~95% of a distance from a center of the shadow mask to an end of a short axis of the shadow mask.

9. The cathode ray tube of claim 1, wherein the ratio Sh/Sv satisfied a condition $0.95 \leqq Sh/Sv \leqq 1.03$ at a region corresponding to 80%~95% of a distance from a center of the shadow mask to an end of a long axis of the shadow mask.

10. The cathode ray tube of claim 1, wherein the ratio Sh/Sv satisfies a condition $0.95 \leqq Sh/Sv \leqq 1.05$ at a region corresponding to 80%~95% of a distance from a center of the shadow mask to an end of a diagonal axis of the shadow mask.

11. A cathode ray tube comprising:

a panel having an outer surface which is substantially flat and an inner surface which has a radius of curvature; and a shadow mask having a plurality of apertures through which electron beams pass, wherein a ratio Sh/Sv of a horizontal dimension Sh of the aperture to a vertical dimension Sv of the aperture satisfies a condition of $0.89 \leqq Sh/Sv \leqq 0.95$ at a central portion of the shadow mask.

12. The cathode ray tube of claim 11, wherein the ratio Sh/Sv satisfies a condition of $Sh/Sv<1$ at an end portion of a short axis of the shadow mask.

13. The cathode ray tube of claim 12, wherein the ratio Sh/Sv satisfies a condition of $Sh/Sv \geqq 1$ at an end portion of a diagonal axis of the shadow mask.

14. The cathode ray tube of claim 12, wherein the ratio Sh/Sv satisfies $Sh/Sv \geqq 1$ at an end portion in a long axis of the shadow mask.

15. The cathode ray tube of claim 11, wherein the ratio Sh/Sv satisfies a condition of $Sh/Sv<1$ on a short axis of the shadow mask.

16. The cathode ray tube of claim 11, wherein the ratio Sh/Sv satisfied a condition $0.95 \leqq Sh/Sv \leqq 1.03$ at a region corresponding to 80%~95% of a distance from a center of the shadow mask to an end of a long axis of the shadow mask.

17. The cathode ray tube of claim 11, wherein the ratio Sh/Sv satisfies a condition $0.95 \leqq Sh/Sv \leqq 1.05$ at a region corresponding to 80%~95% of a distance from a center of the shadow mask to an end of a diagonal axis of the shadow mask.

18. A cathode ray tube comprising:

a panel having an outer surface which is substantially flat and an inner surface which has a radius of curvature; and a shadow mask having a plurality of apertures through which electron beams pass, wherein a ratio Sh/Sv of a horizontal dimension Sh of the aperture to a vertical dimension Sv of the aperture satisfies a condition of $Sh/Sv<1$ at a central portion of the shadow mask, and, by defining the ratio Sh/Sv at the central portion of the shadow mask as A and the ratio Sh/Sv at an end portion of a diagonal axis of the shadow mask as B, a ratio B/A satisfies a condition of $B/A \geqq 1.1$.

19. The cathode ray tube of claim 18, wherein the ratio Sh/Sv satisfies a condition of $Sh/Sv<1$ at an end portion of a short axis of the shadow mask.

20. The cathode ray tube of claim 19, wherein the ratio Sh/Sv satisfies a condition of $Sh/Sv \geqq 1$ at an end portion of a diagonal axis of the shadow mask.

21. The cathode ray tube of claim 19, wherein the ratio Sh/Sv satisfies $Sh/Sv \geqq 1$ at an end portion in a long axis of the shadow mask.

22. The cathode ray tube of claim 18, wherein the ratio Sh/Sv satisfies a condition of $Sh/Sv<1$ on a short axis of the shadow mask.

23. The cathode ray tube of claim 18, wherein the ratio Sh/Sv satisfied a condition $0.95 \leqq Sh/Sv \leqq 1.03$ at a region corresponding to 80%~95% of a distance from a center of the shadow mask to an end of a long axis of the shadow mask.

24. The cathode ray tube of claim 18, wherein the ratio Sh/Sv satisfies a condition $0.95 \leqq Sh/Sv \leqq 1.05$ at a region corresponding to 80%~95% of a distance from a center of the shadow mask to an end of a diagonal axis of the shadow mask.

25. A cathode ray tube comprising:

a panel having an outer surface which is substantially flat and an inner surface which has a radius of curvature; and a shadow mask having a plurality of apertures through which electron beams pass, wherein a ratio Sh/Sv of a horizontal dimension Sh of the aperture to a vertical dimension Sv of the aperture satisfies a condition of $Sh/Sv<1$ at a central portion of the shadow mask, and the ratio Sh/Sv satisfies a condition $0.90 \leqq Sh/Sv \leqq 0.96$ at a region corresponding to 80%~95% of a distance from a center of the shadow mask to an end of a short axis of the shadow mask.

26. The cathode ray tube of claim 25, wherein the ratio Sh/Sv satisfies a condition of $Sh/Sv<1$ at an end portion of a short axis of the shadow mask.

27. The cathode ray tube of claim 26, wherein the ratio Sh/Sv satisfies a condition of $Sh/Sv \geqq 1$ at an end portion of a diagonal axis of the shadow mask.

28. The cathode ray tube of claim 26, wherein the ratio Sh/Sv satisfies $Sh/Sv \geqq 1$ at an end portion in a long axis of the shadow mask.

29. The cathode ray tube of claim 25, wherein the ratio Sh/Sv satisfies a condition of $Sh/Sv<1$ on a short axis of the shadow mask.

30. The cathode ray tube of claim 25, wherein the ratio Sh/Sv satisfied a condition $0.95 \leqq Sh/Sv \leqq 1.03$ at a region corresponding to 80%~95% of a distance from a center of the shadow mask to an end of a long axis of the shadow mask.

31. The cathode ray tube of claim 25, wherein the ratio Sh/Sv satisfies a condition $0.95 \leqq Sh/Sv \leqq 1.05$ at a region corresponding to 80%~95% of a distance from a center of the shadow mask to an end of a diagonal axis of the shadow mask.

* * * * *